US012622538B2

(12) United States Patent
Tortorello

(10) Patent No.: US 12,622,538 B2
(45) Date of Patent: May 12, 2026

(54) SERVING TRAY AND METHODS OF USE

(71) Applicant: Melissa Tortorello, Barnegat, NJ (US)

(72) Inventor: Melissa Tortorello, Barnegat, NJ (US)

( * ) Notice: Subject to any disclaimer, the term of this patent is extended or adjusted under 35 U.S.C. 154(b) by 35 days.

(21) Appl. No.: 18/679,549

(22) Filed: May 31, 2024

(65) Prior Publication Data

US 2024/0398143 A1 Dec. 5, 2024

Related U.S. Application Data

(60) Provisional application No. 63/505,748, filed on Jun. 2, 2023.

(51) Int. Cl.
*A47G 23/06* (2006.01)

(52) U.S. Cl.
CPC ..... *A47G 23/0625* (2013.01)

(58) Field of Classification Search
CPC ..... A47G 23/0625; A47B 23/002
USPC ..... 206/557; 220/556; 294/144; 224/270, 224/218
See application file for complete search history.

(56) References Cited

U.S. PATENT DOCUMENTS 7,975,623 B1 * 7/2011 Gassick ..... A47G 23/0625 248/444
8,973,796 B1 * 3/2015 Abusaoud ..... B65D 1/34 224/222
9,125,506 B2 * 9/2015 McDermott ..... A47G 23/0625
9,687,098 B1 * 6/2017 Liles ..... A47G 23/0625

* cited by examiner

*Primary Examiner* — Corey N Skurdal
(74) *Attorney, Agent, or Firm* — SLEMAN & LUND LLP

(57) ABSTRACT

A serving tray assembly includes a platform, a spacer coupled to the platform, at least one metallic element coupled to the spacer, and a handling subassembly releasably coupleable to the spacer and comprising a pole orthogonal to the platform, a support ring coupled to the pole, and at least one magnetic element coupled to the support ring, the at least one magnetic element being aligned with and magnetically coupleable to the at least one metallic element.

20 Claims, 6 Drawing Sheets

SERVING TRAY AND METHODS OF USE

CROSS-REFERENCE TO RELATED APPLICATIONS

The present application claims priority to U.S. Provisional Ser. No. 63/505,748, filed on Jun. 2, 2023, the contents of which are hereby incorporated by reference in their entirety as if fully set forth herein.

FIELD OF THE DISCLOSURE

The present disclosure relates to a serving tray and, more specifically, a serving tray with improved stability and ergonomics

BACKGROUND OF THE DISCLOSURE

Serving trays are difficult to carry as more items are added onto the platform. In most cases, the server places the bottom of the tray platform on their palm. This requires the server to move around with extreme caution and balance to prevent spilling and/or dropping. It generally takes some practice in order to be able to balance multiple items on a tray.

Cramping is another issue with modern serving trays. As the server balances the tray on the palm and/or fingers, the muscles in the wrist, forearm, biceps, triceps, and neck fatigue. Over time, the server may struggle to maintain the tray's balance, which results in soreness and additional fatigue. As the server attempts to compensate for fatigue by spreading the fingers widely on the bottom of the tray, additional strain is placed on the wrist. The overall effect leads to joint instability and overuse. Poor ergonomics are not only unpleasant, but may also result in severe workplace injury.

Finally, as the server approaches the desired table it becomes difficult to place the tray on a flat surface since the server's palm is resting on the bottom of the tray. In order to place the tray on a flat surface, or on a table, the server must slide their hand between the flat surface and the table causing the tray to become unstable, which increases the chance of the tray tipping over, and potentially falling. Thus, the conventional devices may result in injury to the server, loss to the restaurant and inconvenience to the patrons.

SUMMARY OF THE DISCLOSURE

In some examples, a serving tray assembly includes a platform, a spacer coupled to the platform, at least one metallic element coupled to the spacer; and a handling subassembly releasably coupleable to the spacer and comprising a pole orthogonal to the platform, a support ring coupled to the pole, and at least one magnetic element coupled to the support ring, the at least one magnetic element being aligned with and magnetically coupleable to the at least one metallic element.

BRIEF DESCRIPTION OF THE DISCLOSURE

Figure 1A:
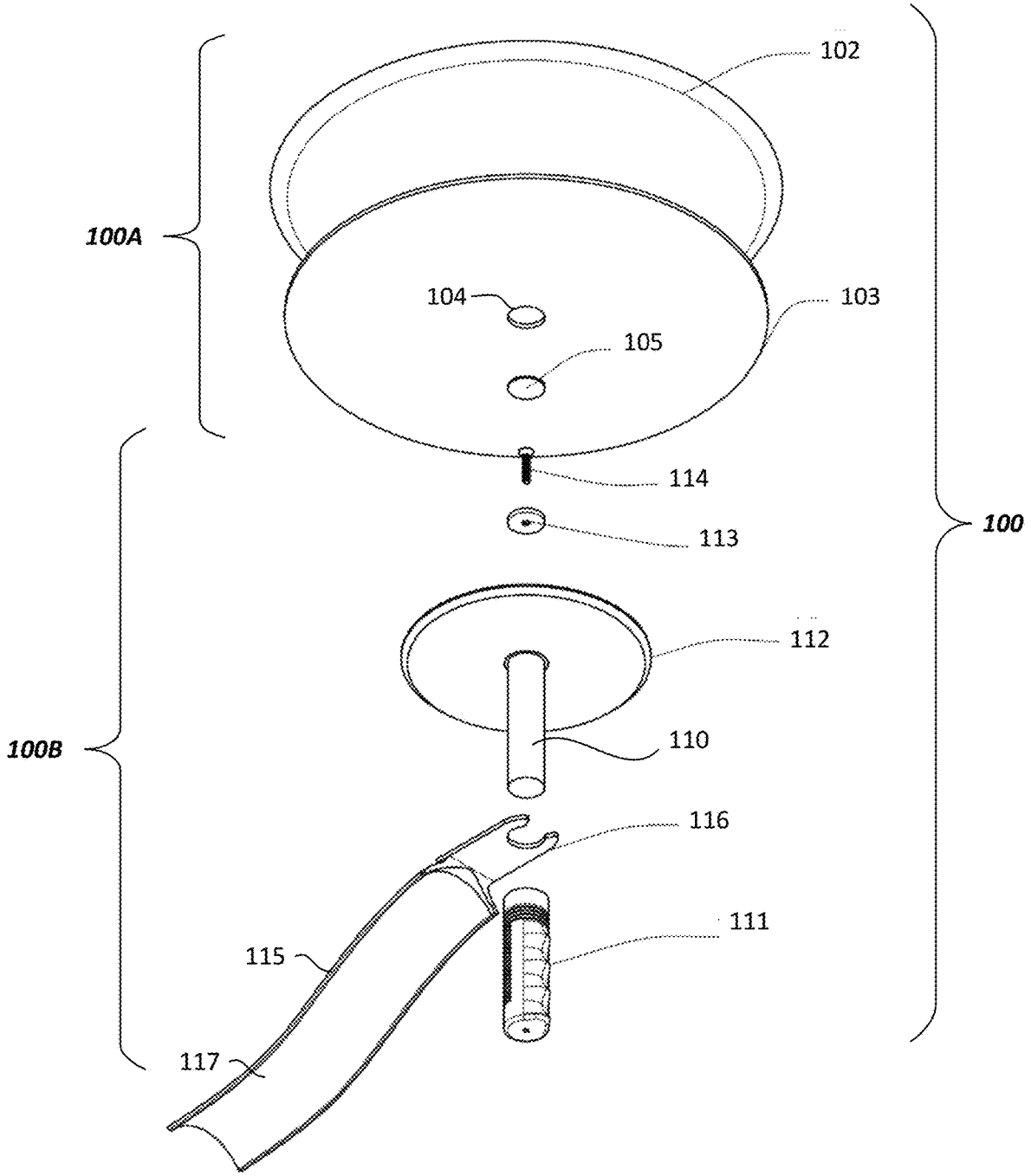
Figure 1B:
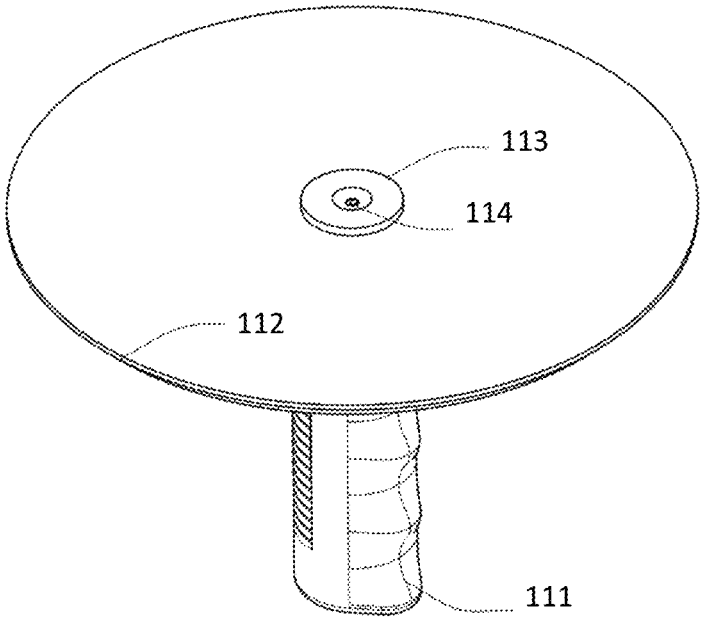
Figure 1C:
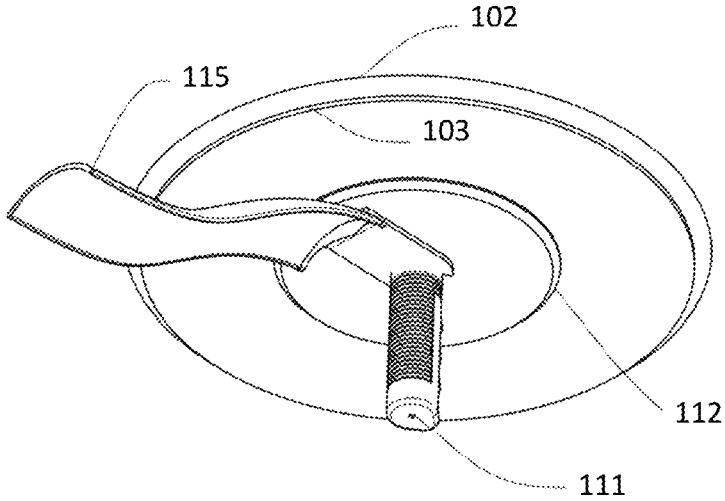
Figure 2A:
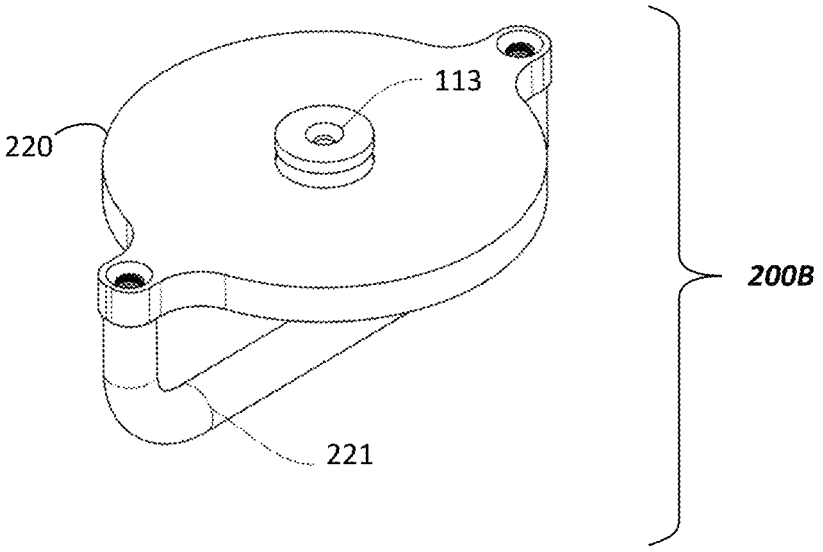
Figure 2B:
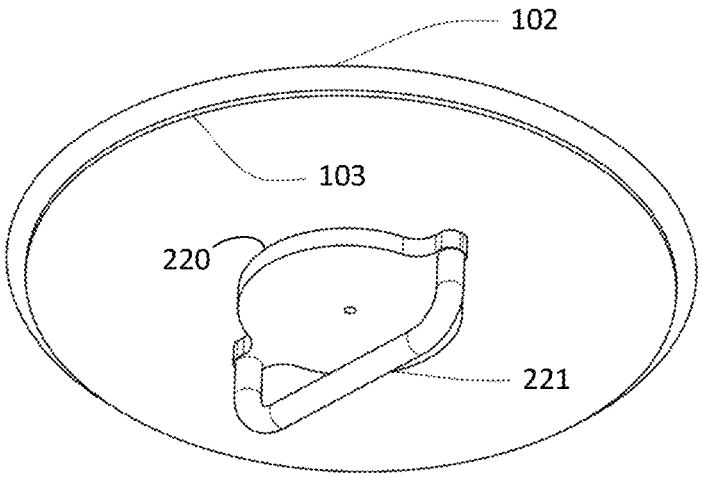
Figure 3:
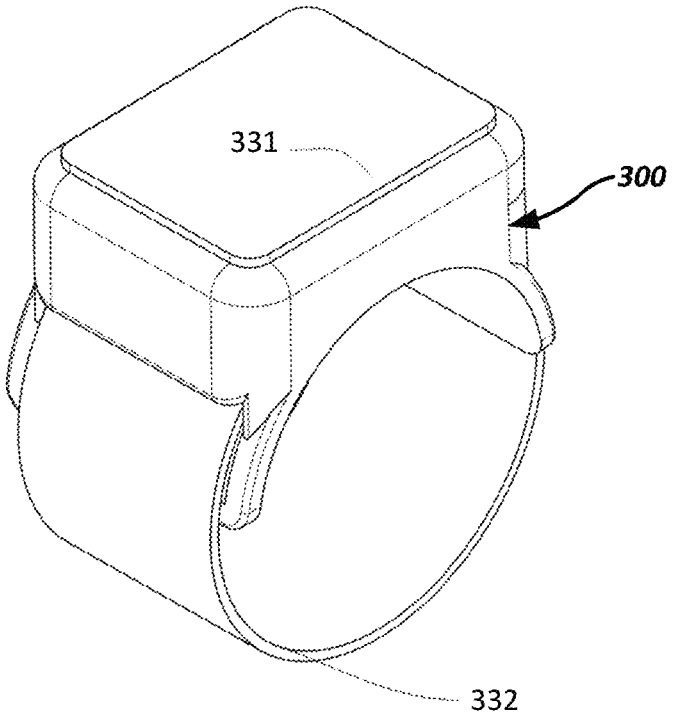
Figure 4A:
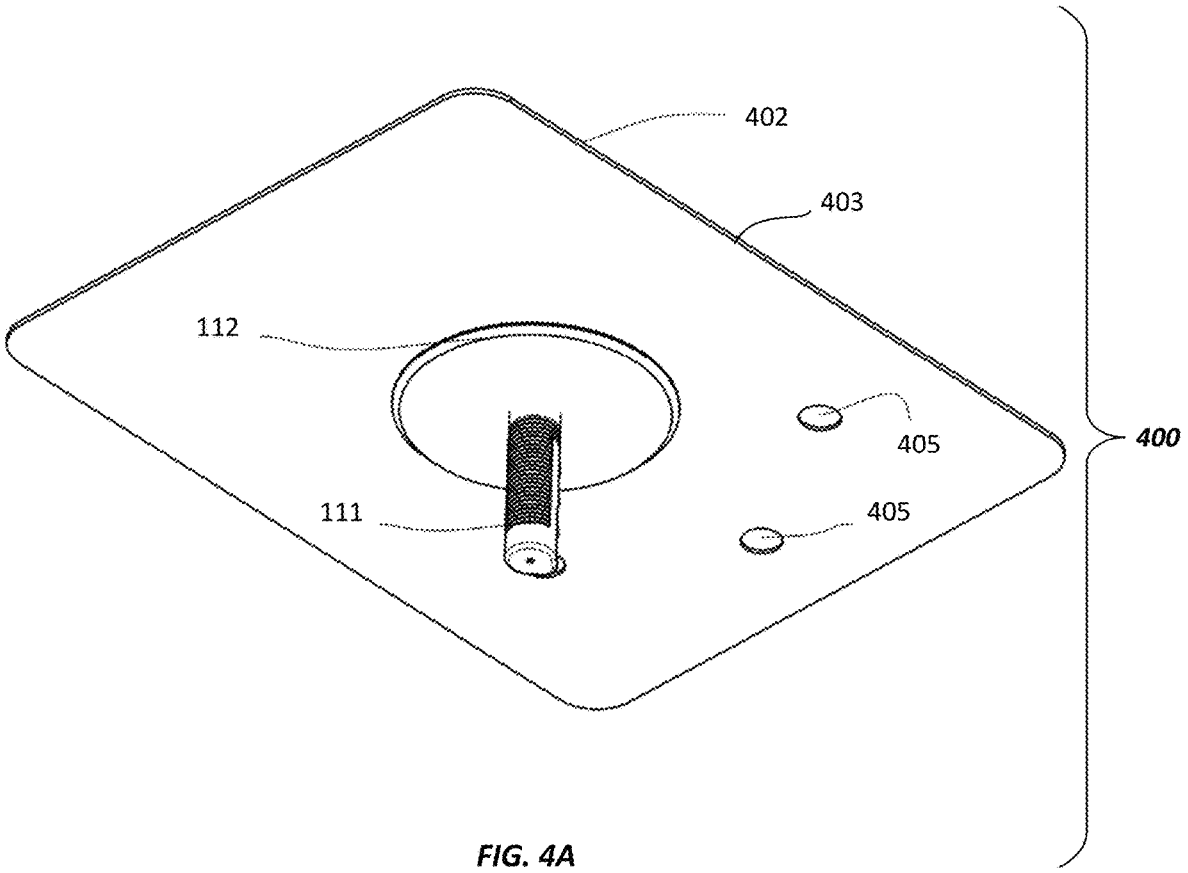
Figure 4B:
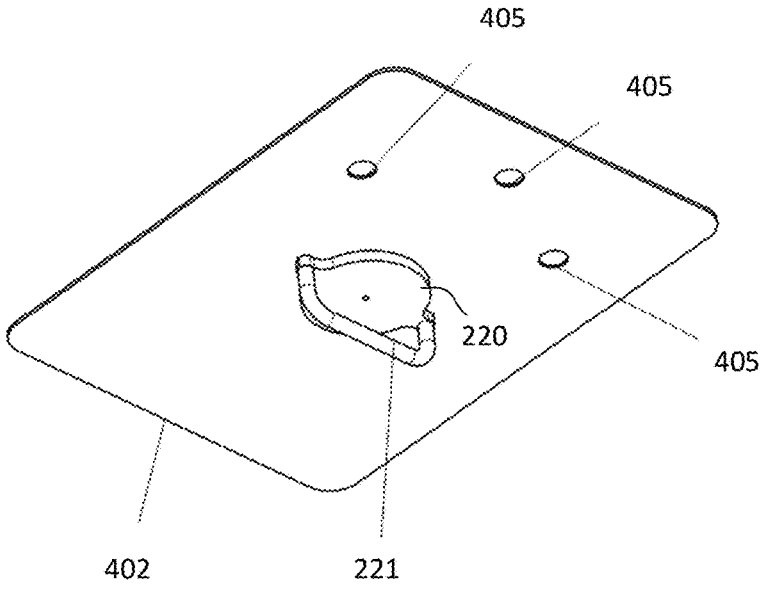
Figure 4C:
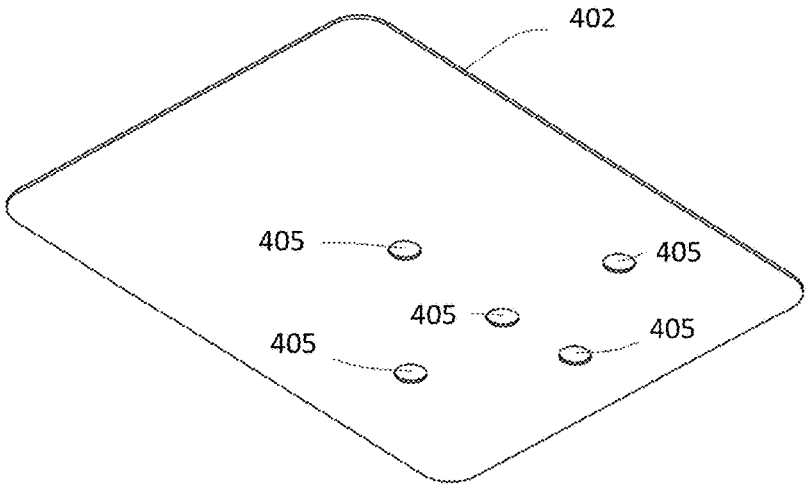

Embodiments of the presently disclosed devices and systems are shown herein with reference to the drawings, wherein:

FIGS. 1A-C are schematic perspective views of a circular tray according to one embodiment;

FIGS. 2A-B illustrate an alternative gripping mechanism for use with the circular tray of FIGS. 1A-C;

FIG. 3 is a schematic perspective view of an optional armrest for use with the circular tray of FIGS. 1A-C; and FIGS. 4A-C are schematic perspective views of a rectangular tray according to another embodiment.

The embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made to serving trays and their methods of use, conventional devices suffer from some shortcomings as described above. There therefore is a need for further improvements to the devices, systems, and methods of making and using serving trays. Among other advantages, the present disclosure may address one or more of these needs.

FIG. 1A depicts one embodiment of a serving tray system 100 that includes a flat, circular platform 102 and a circular spacer 103 that form a serving subassembly 100A. The circular platform 102 and the circular spacer are of approximately a same size and the platform 102 may have a lip that surrounds the outer circumference of circular spacer 103. Platform 102 and spacer 103 may be friction fit with one another, or otherwise coupled using any suitable means (e.g., via fasteners, adhesive, etc.). Alternatively, platform and spacer may be integrally formed. Spacer 103 may be formed of an acrylic sheet of approximately 3 mm in thickness and may have an aperture 104 configured to receive a metallic element 105 (e.g., a steel washer or ⅞ steel blanks or magnet, if desired).

The lower part of serving tray system 100 includes a handling subassembly 100B formed of a vertically-extending pole 110 covered by a cushioned plastic grip 111 (e.g., round, flexible or deformable vinyl grip). Pole 110 may be coupled to a circular support ring 112 and to a magnetic element 113 via a fastener 114. In some examples, support ring 112 is approximately 150 mm in diameter and used to support the loaded weight of the tray. The diameter of the support ring may between 40%-80% of the diameter of platform 102, or between 50% and 60% the diameter of platform 102 (e.g., 55% the diameter of the platform). Magnetic element 113 may be used to releasably couple the handling subassembly 100B with the platform 102. In some examples, magnetic element 113 may include a neodymium magnet or a ceramic magnet, rated at 8 lbs, 10 lbs, 15 lbs., 20 lbs or more in pull force. Magnetic element 113 may be aligned with metallic element 105 so that the two elements are magnetically attracted to couple the handling subassembly with platform 102. Alternatively, metallic element 105 may be replaced with a magnet so that both the upper assembly and the lower assembly have magnets of opposing polarity facing one another. FIG. 1B illustrate the assembled handling subassembly 100B with the magnetic element 113 being disposed at the top of the subassembly.

An optional forearm arc support 115 may be coupled to handling subassembly 100B at fixation end 116, shown here as a circular recess to mate with vertically-extending pole 110. Of course, other variations of coupling fixation end 116 to the vertically-extending pole 110 are possible. Forearm arc support 115 further includes a generally curved track 117 having a concavity that extends from the handling subassembly 100B, the concavity being configured to rest on the user's forearm during use. FIG. 1C illustrates the assembled handling subassembly 100B with the optional forearm arc support 115.

In one variation, shown in FIGS. 2A-B, a different handling subassembly 200B is illustrated, which may be used with serving subassembly 100A. That is, handling subassembly 200B may be interchangeable with handling subassembly 100B. Handling subassembly 200B may include a circular base 220 that receives magnetic element 113 on one side, and a U-shaped handle 221 on the other side that includes two fixation points attached to circular base 220 and a horizontal grip. FIG. 2B shows handling subassembly 200B being coupled to serving subassembly 100A of the previous embodiment.

Optionally, an arm rest strap 300 may be used that includes an arm band 332 and a cushion 331. Arm rest strap 300 may remain with the user, and may include a VELCRO® strap on arm band 332 so that the user may position it as desired. In some examples, arm rest strap 300 may be positioned on the forearm or may be moved up to the shoulder area for larger trays that are carried on the shoulder. Arm rest strap 300 may have a thick deformable material at cushion 331 on the top where the tray will rest and/or on the bottom at the area that meets the user's body.

FIGS. 4A-C depicts another embodiment of a serving tray system 400 that includes a flat, rectangular platform 402 and a rectangular spacer 403 that form a serving subassembly. Platform 402 may be of a common tray size (e.g., 18 by 24 inches). The rectangular platform 402 and the rectangular spacer 403 may be of approximately a same size and the platform 402 may have a lip that surrounds the outer diameter of rectangular spacer 403. Spacer 403 may be formed of an acrylic sheet of approximately 3 mm in thickness and may have an aperture 104 configured to receive one or more metallic elements 405 (e.g., a steel washer or ⅞ steel blanks or magnets, if desired). In this example, two metallic elements 405 are disposed on a centerline of the platform and two additional metallic elements are disposed offset from the centerline. The user may choose to couple handling subassembly to the metallic element(s) (or magnet(s)) of their choosing.

In FIG. 4A, the lower part of tray system 400 includes the same handling subassembly 100B previously described, including a vertically-extending pole 110 covered by a cushioned plastic grip 111 (e.g., round, flexible or deformable vinyl grip). Pole 110 is again coupled to a circular support ring 112 and to a magnetic element 113 via a fastener 114. Magnetic element 113 may be aligned with any one of metallic elements 405 so that the two elements are magnetically attracted to couple the handling subassembly with the platform 102.

In FIG. 4B, handling subassembly 200B is illustrated being coupled to rectangular platform 402. That is, handling subassembly 200B may be interchangeable with handling subassembly 100B in this example as well. As previously described, handling subassembly 200B may include a circular base 220 that receives magnetic element 113, and a U-shaped handle 221 that includes two fixation points attached to circular base 220 and a horizontal grip. As previously noted, the number and positions of metallic elements 405 may be chosen as desired, and rectangular spacer 403 may receive one, two, three, four, five or more metallic elements (FIG. 4C).

Other variations are possible. For example, the tray may have different shapes (e.g., circular, oval, square, triangular, etc.) and a serving tray system 100 may utilize multiple handling subassemblies at the same time (e.g., two handling subassemblies coupled to the bottom of a tray, which are the same or different than one another). Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A serving tray assembly comprising:
a platform;
a spacer coupled to the platform;
at least one metallic element coupled to the spacer; and
a handling subassembly releasably coupleable to the spacer and comprising:
a pole orthogonal to the platform;
a circular support ring coupled to the pole and positioned for direct contact with the spacer and the platform, a diameter of the circular support ring being between 50% and 60% of the diameter of platform; and
at least one magnetic element coupled to the circular support ring and disposed above the circular support ring and being spaced away from the pole by the circular support ring, the at least one magnetic element being aligned with and magnetically coupleable to the at least one metallic element.

2. The serving tray assembly of claim 1, wherein the platform and the spacer have a same shape.

3. The serving tray assembly of claim 1, wherein the platform is circular.

4. The serving tray assembly of claim 1, wherein the platform is rectangular.

5. The serving tray assembly of claim 1, wherein the spacer includes an aperture for receiving the at least one metallic element.

6. The serving tray assembly of claim 1, wherein the spacer comprises acrylic.

7. The serving tray assembly of claim 1, wherein the pole is covered by a cushioned grip.

8. The serving tray assembly of claim 1, further comprising a forearm arc support coupleable to the pole.

9. The serving tray assembly of claim 8, wherein the forearm arc support includes a curved track having a concavity for resting on a user's arm.

10. The serving tray assembly of claim 1, wherein the at least one metallic element includes multiple metallic elements.

11. The serving tray assembly of claim 1, wherein the at least one metallic element includes a magnet.

12. The serving tray assembly of claim 1, wherein the at least one magnetic element includes a neodymium magnet.

13. The serving tray assembly of claim 1, wherein the support ring defines an area that is at least 40% of the area of the platform.

14. A serving tray assembly comprising:
a platform;
a spacer coupled to the platform;
at least one metallic element coupled to the spacer; and a handling subassembly releasably coupleable to the spacer and comprising:

a circular base positioned for direct contact with the spacer and the platform;

a U-shaped handle disposed on an opposing side of the base; and at least one magnetic element coupled to a first side of the base, the at least one magnetic element being aligned with and magnetically coupleable to the at least one metallic element, the at least one magnetic element being disposed above the circular base and being spaced away from the U-shaped handle by the circular base, the at least one magnetic element being aligned with and magnetically coupleable to the at least one metallic element.

15. The serving tray assembly of claim 14, wherein the platform and the spacer have a same shape.

16. The serving tray assembly of claim 14, wherein the platform is circular.

17. The serving tray assembly of claim 14, wherein the platform is rectangular.

18. The serving tray assembly of claim 14, wherein the spacer includes an aperture for receiving the at least one metallic element.

19. The serving tray assembly of claim 14, wherein the at least one metallic element includes multiple metallic elements.

20. The serving tray assembly of claim 14, wherein the at least one metallic element includes a magnet.

* * * * *